US006464788B2

(12) United States Patent
Falck et al.

(10) Patent No.: US 6,464,788 B2
(45) Date of Patent: Oct. 15, 2002

(54) LIQUID RECOVERY AND RECLAMATION SYSTEM

(75) Inventors: Michael E. Falck, Wanatah, IN (US); Norbert A. Satkoski, Union Mills, IN (US)

(73) Assignee: Roll Coater, Inc., Greenfield, IN (US)

( * ) Notice: Subject to any disclaimer, the term of this patent is extended or adjusted under 35 U.S.C. 154(b) by 0 days.

(21) Appl. No.: 09/785,377

(22) Filed: Feb. 16, 2001

(65) Prior Publication Data

US 2001/0047754 A1 Dec. 6, 2001

Related U.S. Application Data

(60) Provisional application No. 60/183,065, filed on Feb. 16, 2000.

(51) Int. Cl.[7] ..... B05C 11/00; B05C 1/00; B05C 5/00

(52) U.S. Cl. ..... 118/602; 118/226; 118/234; 118/255; 118/264; 118/312; 118/429

(58) Field of Search ..... 118/203, 216, 118/225, 226, 234, 255, 256, 260, 264, 268, 316, 325, 401–405, 410, 411, 419, 420, 501, 602, 672, 677, 678, 681, 31, 207, 208, 307, 312, 429; 156/356, 578

(56) References Cited

U.S. PATENT DOCUMENTS

| | | | | | |
|---|---|---|---|---|---|
| 3,877,414 | A | * | 4/1975 | Brideau et al. | 118/234 |
| 4,055,971 | A | * | 11/1977 | Hermes | 68/9 |
| 4,604,300 | A | | 8/1986 | Keys et al. | |
| 4,637,341 | A | * | 1/1987 | Switall | 118/223 |
| 5,549,752 | A | | 8/1996 | Hahn et al. | |
| 5,985,028 | A | | 11/1999 | Cornell et al. | |
| 6,013,312 | A | | 1/2000 | Cornell et al. | |
| 6,235,199 | B1 | * | 5/2001 | Peterson et al. | 210/646 |

* cited by examiner

*Primary Examiner*—Richard Crispino
*Assistant Examiner*—Kevin P. Shortsle
(74) *Attorney, Agent, or Firm*—Barnes & Thornburg

(57) ABSTRACT

A coating apparatus is configured to coat a moving strip of material with liquid coating material. The apparatus includes a liquid coating material supply unit and a coater for dispensing liquid coating material onto the moving strip of material. A recycler is provided for returning liquid coating material dispensed from the coater to a position in the coating apparatus upstream of the coater.

12 Claims, 4 Drawing Sheets

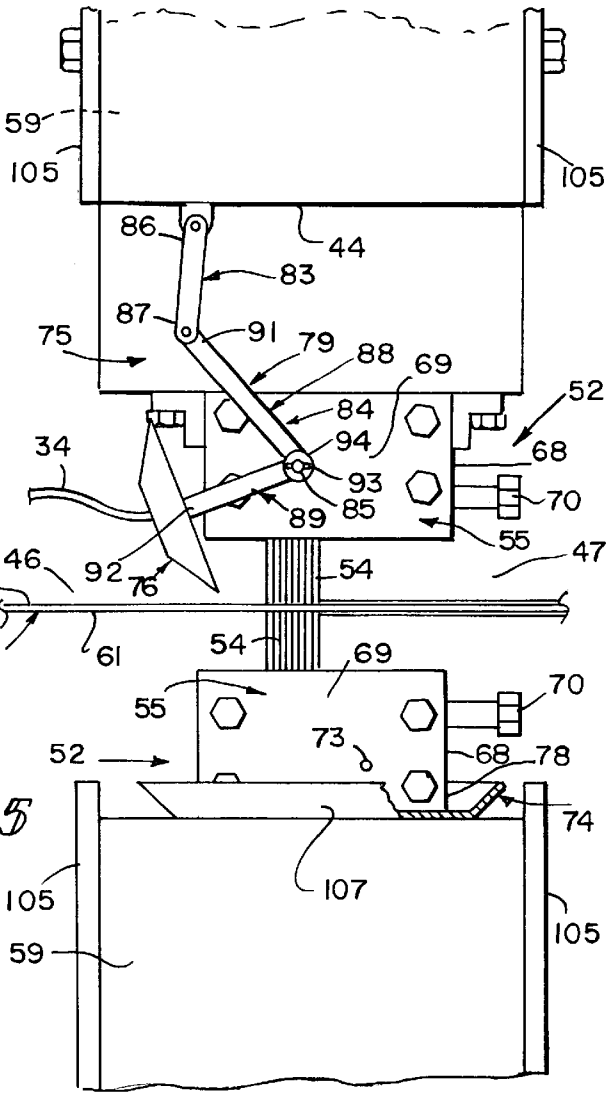
FIG. 4
FIG. 5
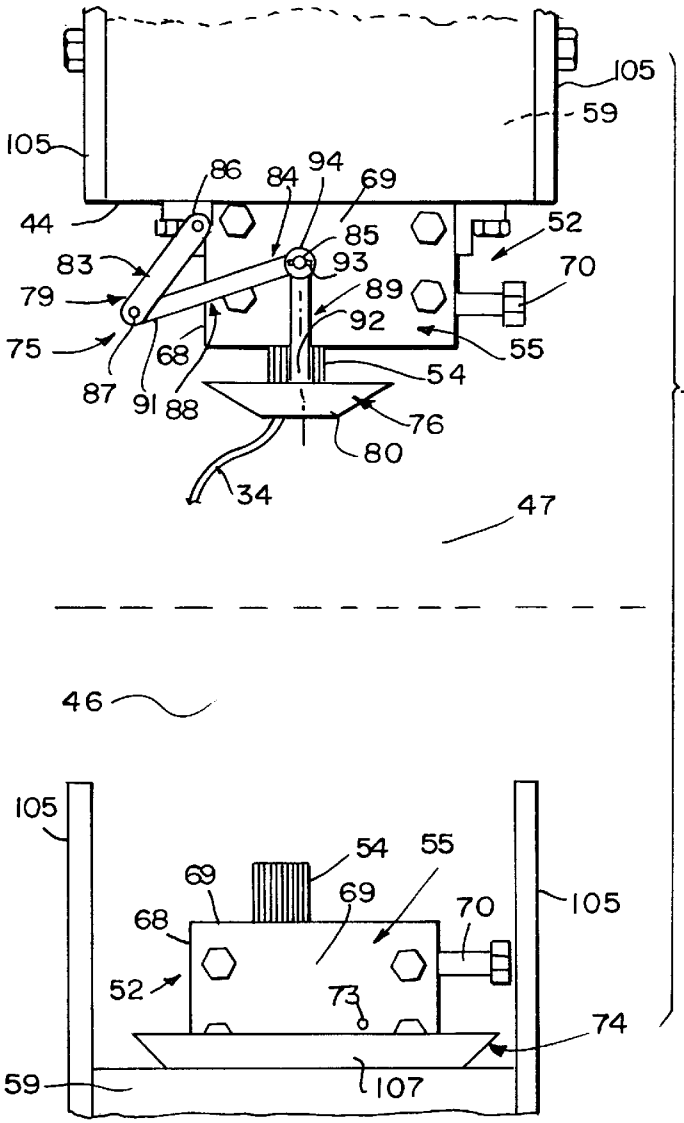

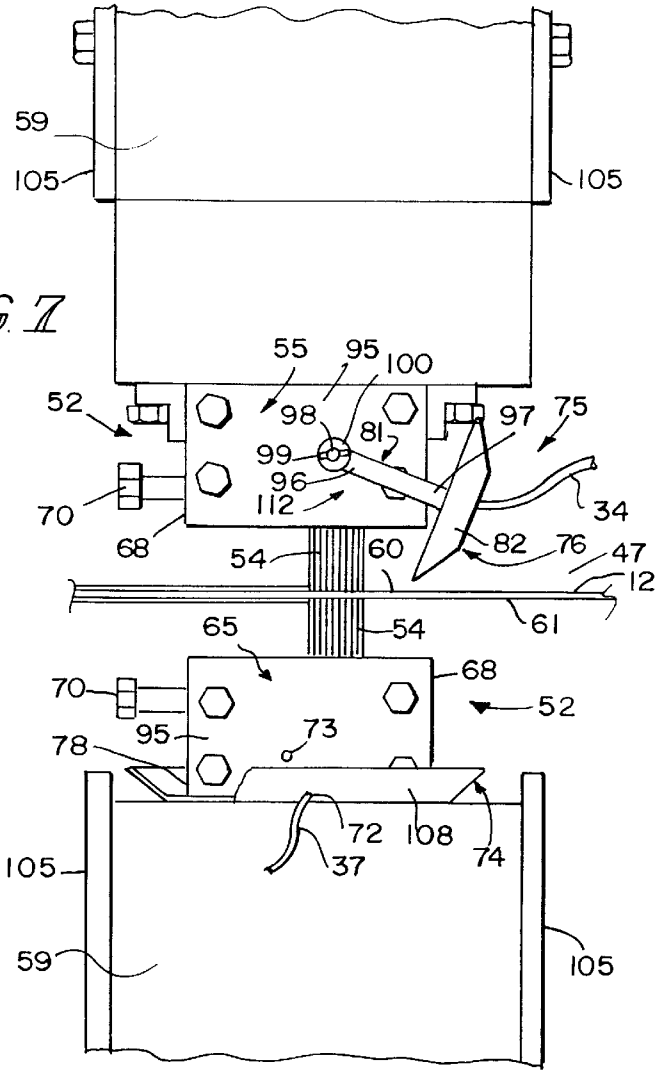
FIG. 7
FIG. 6
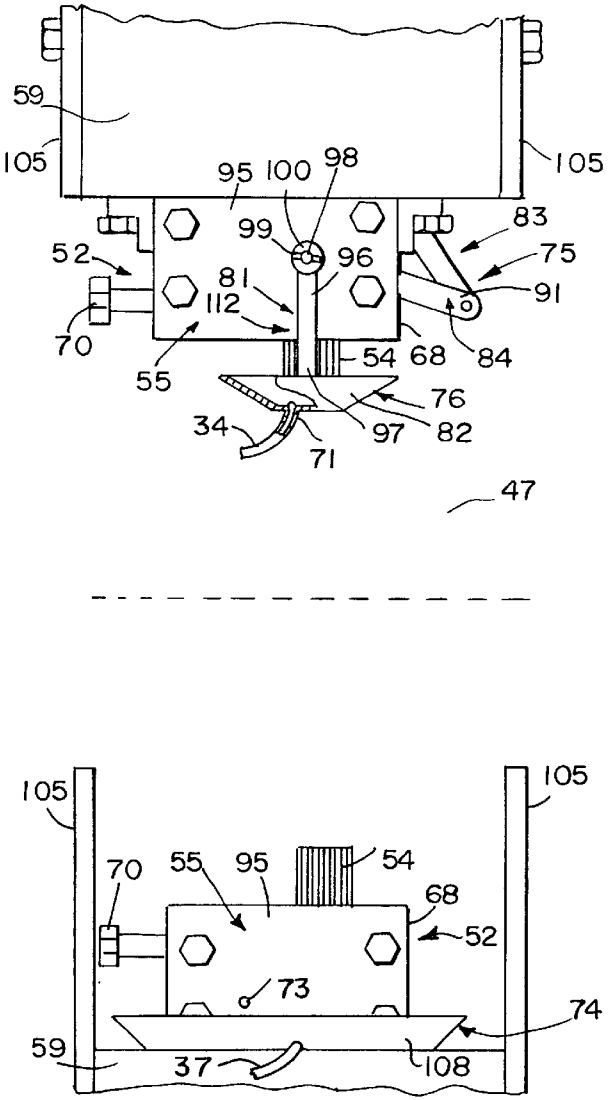

LIQUID RECOVERY AND RECLAMATION SYSTEM

This application claims priority under 35 U.S.C. § 119(e) to U.S. Provisional Application Serial No. 60/183,065, filed Feb. 16, 2000, which is expressly incorporated by reference herein.

BACKGROUND AND SUMMARY OF THE INVENTION

The present invention relates to a coating apparatus, and particularly to an apparatus for coating strip material. More particularly, the present invention relates to a system for limiting wastage of liquid coating material by the coating apparatus.

Coating apparatus are configured to apply a coating onto material. See, for example, U.S. Pat. No. 6,013,312 to Cornell et al., U.S. Pat. No. 5,985,028 to Cornell et al., U.S. Pat. No. 5,549,752 to Hahn et al., and U.S. Pat. No. 4,604,300 to Keys et al.

According to the present invention, a coating apparatus for coating a moving strip of material with liquid coating material comprises a liquid coating material supply unit configured to dispense liquid coating material and a coater configured to dispense liquid coating material provided by the liquid coating material supply unit onto the moving strip of material. The coating apparatus further includes recycle means for returning liquid coating material dispensed from the coater to a position in the coating apparatus upstream of the coater.

In preferred embodiments, the recycle means include a collector for collecting liquid coating material dispensed from the coater, a director for directing liquid coating material received from the collector either to the liquid coating material supply unit or to a liquid usage detector, and a filter arranged to receive liquid coating material from the collector and discharge that liquid coating material to the director.

The coater includes an upper applicator overlying the moving strip of material and a lower applicator underlying the moving strip of material. The collector includes an upper recovery receptacle arranged to collect liquid coating material dispensed from the upper applicator and a lower recovery receptacle arranged to collect liquid coating material dispensed from the lower applicator. Each of the upper and lower applicators includes a coating discharger made of felt and configured to apply liquid coating material onto the moving strip. The recycle means further includes means for swinging the upper recovery receptacle along a path between a recovery position in which the upper recovery receptacle is positioned under the upper applicator and a storage position away from the recovery position.

Additional features of the present invention will become apparent to those skilled in the art upon consideration of the following detailed description of the invention.

BRIEF DESCRIPTION OF THE DRAWINGS

The detailed description particularly refers to the accompanying figures in which:

FIG. 4 is a side elevation view taken along line 4—4 of FIG. 3, with portions broken away, showing the right, rear coater opened and first ends of the upper and lower recovery receptacles which are coupled to the right, rear coater, the lower recovery receptacle coupled to the lower applicator, a drive linkage coupled to a frame of the right, rear coater and the first end of the upper recovery receptacle to position the upper recovery receptacle directly under the upper applicator when the coater is opened;

FIG. 5 is a side elevation view taken along line 5—5 of FIG. 3, with portions broken away, showing the left, front coater closed to apply liquid coating material to the moving metal strip, first ends of the upper and lower recovery receptacles which are coupled to the left, front coater, the lower recovery receptacle coupled to the lower applicator, a drive linkage coupled to a frame of the left, front coater and the first end of the upper recovery receptacle to position the upper recovery receptacle in the storage position when the coater is closed;

FIG. 6 is a side elevation view taken along line 6—6 of FIG. 3, with portions broken away, showing the right, rear coater opened, second ends of the upper and lower recovery receptacles which are coupled to the right, rear coater, an idler linkage coupled to the upper applicator and the second end of the upper recovery receptacle to support the second end when the upper recovery receptacle is in the recovery position; and FIG. 7 is a side elevation view taken along line 7—7 of FIG. 3, with portions broken away, showing the left, front coater closed, left ends of the upper and lower recovery receptacles which are coupled to the left, front coater, an idler linkage coupled to the upper applicator and the second end of the upper recovery receptacle to support the second end when the upper recovery receptacle is in the storage position.

DETAILED DESCRIPTION OF THE DRAWINGS

Figure 1:
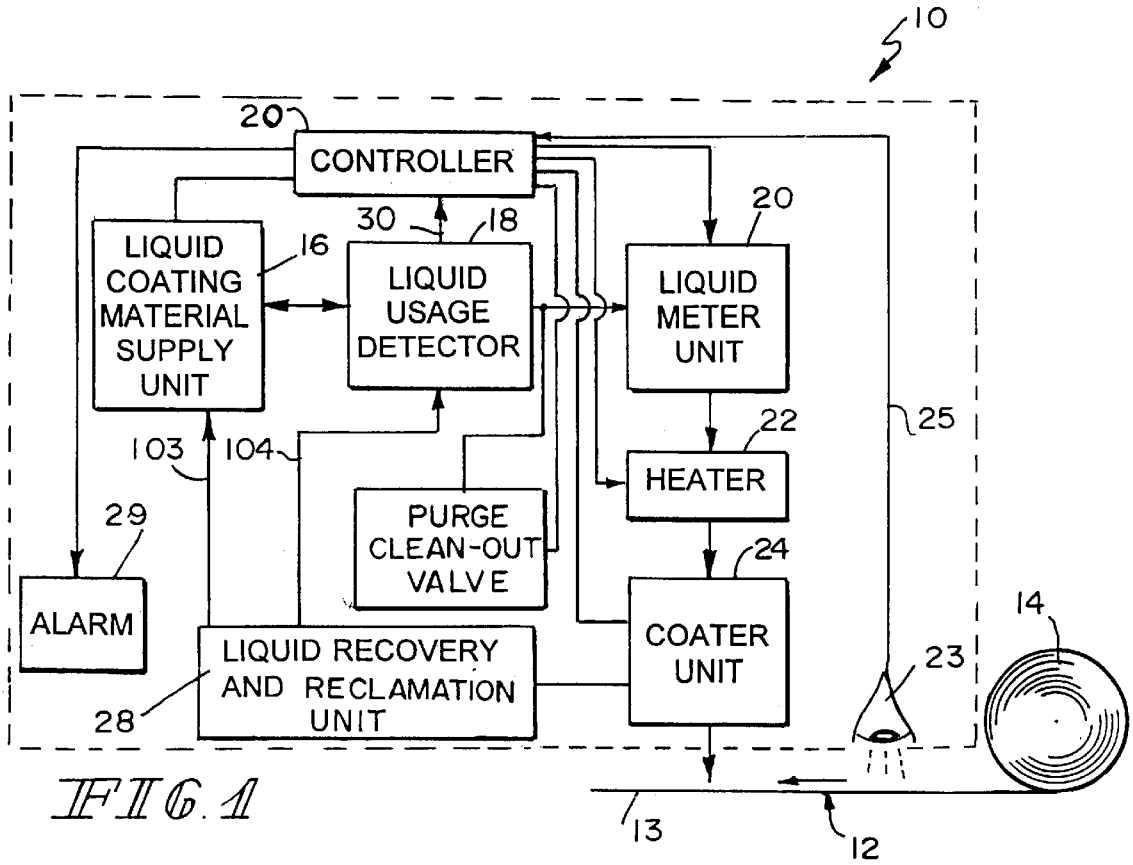
FIG. 1 is a diagrammatic view of a coating apparatus configured to apply a metered amount of liquid coating material onto a moving metal strip, the coating apparatus including a coating recovery system configured to recover excess liquid coating material from a coater unit to return the excess for reuse.

A metal strip coating apparatus 10 is configured to apply a regulated amount of liquid coating material to a moving metal strip 12 provided by a metal strip supply 14, as shown, for example, in FIG. 1. Coating apparatus 10 includes a liquid coating material supply unit 16, a liquid usage detector 18, a flow regulator or liquid meter unit 20, an in-line heater 22, a coater unit 24, a controller 26, and a coating return system 28.

Figure 2:
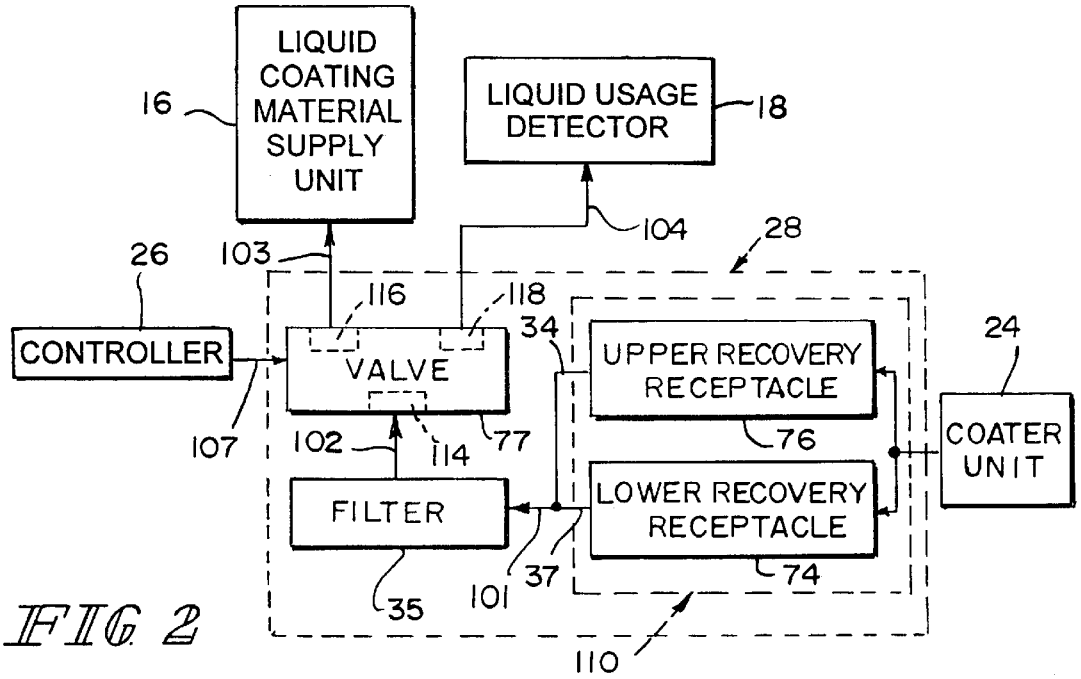
FIG. 2 is a diagrammatic view of the coating return system of FIG. 1 showing the coating return system including upper and lower recovery receptacles, a filter, and a valve coupled to a controller and configured to direct recovered liquid coating material either to a liquid usage detector during normal operation of the coating apparatus or the liquid coating material supply unit during purging and clean-out of the coating apparatus.

Coating return system 28 is configured to recover excess liquid coating material from coater unit 24 to return the excess to a location in coating apparatus upstream from coater unit 24 to limit wastage of liquid coating material, as shown, for example, in FIGS. 1 and 2. In preferred embodiments, coating return system 28 returns the excess to liquid usage detector 18 during normal operation of coating apparatus 10 and to liquid supply unit 16 during purging and cleaning of coating apparatus 10.

Controller 26 is configured to control the application of liquid coating material onto moving metal strip 12, as shown, for example, in FIG. 1. In preferred embodiments, controller 26 is a programmable logic controller supplied by Rockwell Automation located in Milwaukee, Wis.

Liquid supply unit 16 is coupled to controller 26 and includes a container (not shown) that holds liquid coating material, a heater (not shown) that heats liquid coating material in the container, and a transfer pump (not shown) that pumps liquid coating material from the container directly to liquid usage detector 18 in an intermittent fashion for ultimate application to moving metal strip 12 by coater unit 24. Coating return system 28 returns excess liquid coating material to the container when coating apparatus 10 is purged and cleaned.

Liquid usage detector 18 is configured to detect the actual volumetric flow rate of liquid coating material flowing through coating apparatus 10 and to provide a variable, analog signal 30 indicative thereof to controller 26 so that controller 26 can perform closed-loop feedback control of coating apparatus 10 using liquid meter unit 20, as shown, for example, in FIG. 1. Liquid usage detector 18 includes a reservoir (not shown) arranged as a cylindrical tube with an opening to receive liquid coating material being returned to liquid usage detector 18. Coating apparatus 10 can include an alarm 29 coupled to controller 26 and configured to alert an operator when the actual volumetric flow rate is outside of a predetermined range.

Coating apparatus 10 includes a motorized purge clean-out valve 120 positioned downstream of liquid usage detector 18 and upstream of liquid meter unit 20. Controller 26 is coupled to purge clean-out valve 120 to close purge clean-out valve 120 and to open purge clean-out valve 120 to purge the lines of coating apparatus 10 of liquid coating material. In preferred embodiments, purge clean-out valve 120 is automatically operated.

Liquid meter unit 20 is configured to receive liquid coating material from liquid usage detector 18 and is coupled to controller 26 to regulate the amount of liquid coating material that is provided to coater unit 24, as shown, for example, in FIG. 1. In-line heater 22 receives liquid coating material from liquid meter unit 20 and is coupled to controller 26 to heat liquid coating material (in addition to the heating provided by liquid supply unit 16) to a predetermined temperature to facilitate "flash drying" of liquid coating material when it is applied to moving metal strip 12.

From inline heater 22, liquid coating material flows to coater unit 24 for application to moving metal strip 12. Coater unit 24 includes front and rear coaters 32, 33 configured to be moved along a foundation 31 into and out of the production line of moving metal strip 12, as shown, for example, in FIG. 3. When one of coaters 32, 33 is positioned in the production line to coat moving metal strip 12, the other of coaters 32, 33 can be positioned away from the production line for servicing, for example. Each coater 32, 33 includes a coater mover 27 to move respective coater 32, 33 into and out of the production line.

Figure 3:
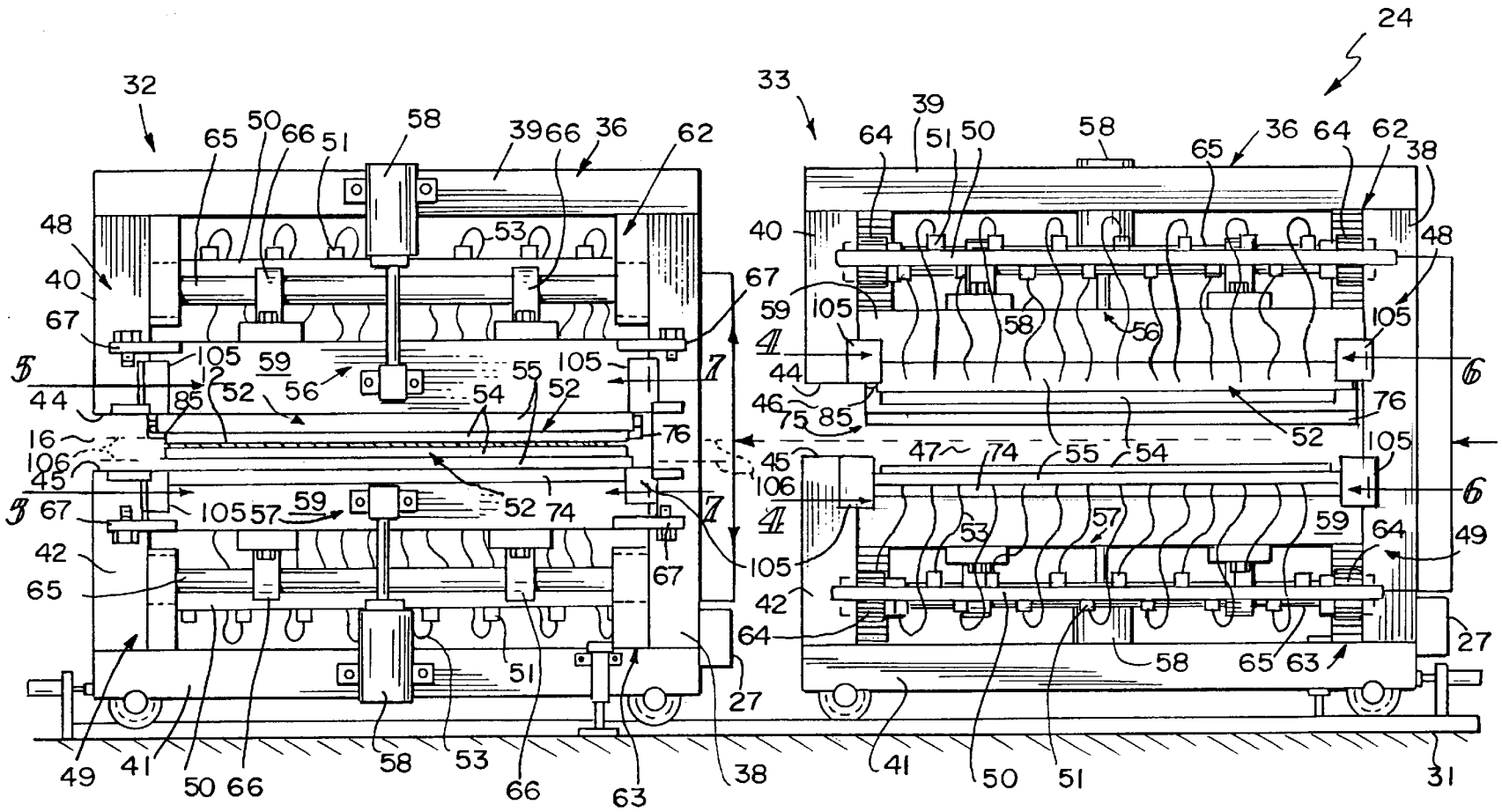
FIG. 3 is a front elevation view of the coater unit of FIG. 1 showing the coater unit including a left, front coater and a right, rear coater, the left, front coater being closed to apply liquid coating material onto the moving metal strip (shown in section), the right, rear coater being opened and spaced apart from the moving metal strip, each of the coaters including upper and lower applicators, upper and lower recovery receptacles being coupled to each of the coaters, the lower recovery receptacles being coupled to the lower applicators to recover liquid coating material discharged therefrom, the upper recovery receptacle coupled to the left, front coater rotated behind the upper applicator of the left, front coater to an out-of-the-way, storage position, the upper recovery receptacle coupled to the right, rear coater rotated under the upper applicator of the right, rear coater to a recovery position to recover liquid coating material discharged therefrom.

Each of coaters 32, 33 includes a C-shaped frame 36, as shown, for example, in FIG. 3. Frame 36 includes a vertical base section 38, an upper horizontal section 39, an upper vertical section 40, a lower horizontal section 41, and a lower vertical section 42. Upper vertical section 40 includes a upper end face 44 and lower vertical section includes a lower end face 45. First and second end faces 44, 45 cooperate to define a strip-receiving opening 46. Frame sections 38, 39, 40, 41, 42 cooperate to define an interior region 47 and, in preferred embodiments, are tubular and square-shaped in cross-section.

Each of coaters 32, 33 includes upper and lower dispenser units 48, 49, as shown, for example, in FIG. 3. Each of dispenser units 48, 49 includes a manifold 50 coupled to frame 36 and configured to receive liquid coating material from in-line heater 22, solenoid valves 51 coupled to respective manifold 50 and controller 26 and configured to receive liquid coating material from respective manifold 50, a coating applicator 52 positioned to lie in interior region 47, and conduits 53 interconnecting respective solenoid valves 51 and respective coating applicator 52. Each coating applicator 52 includes a felt coating discharger 54 configured to apply liquid coating material directly onto a surface of moving metal strip 12 and a felt holder 55 configured to hold respective felt coating discharger 54 therein, as shown, for example, in FIGS. 4–7.

Each of coaters 32, 33 includes an upper applicator mover 56 and a lower applicator mover 57, as shown, for example, in FIG. 3. Each of applicator movers 56, 57 includes an air cylinder unit 58 and an applicator support 59 positioned to lie in interior region 47. Applicator support 59 of upper applicator mover 56 is coupled to felt holder 55 of upper dispenser unit 48. Similarly, applicator support 59 of lower applicator mover 57 is coupled to felt holder 55 of lower dispenser unit 49.

Air cylinder unit 58 of upper applicator mover 56 is coupled to upper horizontal section 39 of frame 36 and applicator support 59 of upper applicator mover 56 to move coating applicator 52 of upper dispenser unit 48 between a retracted or opened position and a protracted or closed position. Similarly, air cylinder unit 58 of lower applicator mover 57 is coupled to lower horizontal section 41 of frame 36 and applicator support 59 of lower applicator mover 57 to move coating applicator 52 of lower dispenser unit 49 between a retracted or open position and a protracted or closed position. In preferred embodiments, applicator supports 59 are tubular and square-shaped in cross-section and applicator movers 56, 57 move respective coating applicators 52 up and down about 4 inches.

In the closed position, felt coating discharger 54 of upper dispenser unit 48 contacts an upper surface 60 of moving metal strip 12 and felt coating discharger 54 of lower dispenser unit 49 contacts a lower surface 61 of moving metal strip 12, as shown, for example, in FIGS. 3, 5, and 7, with respect to front coater 32. In the opened position, felt coating discharger 54 of upper dispenser unit 48 is spaced apart from upper surface 60 of moving metal strip 12 and felt coating discharger 54 of lower dispenser unit 49 is spaced apart from lower surface 61 of moving metal strip 12, as shown, for example, in FIGS. 3, 4, and 6 with respect to rear coater 33.

Each of coaters 32, 33 includes upper and lower alignment units 62, 63 configured to maintain felt coating dischargers 54 in alignment with respective surfaces 60, 61 of moving metal strip 12, as shown, for example, in FIG. 3. Each of alignment units 62, 63 includes a pair of rack-and-pinion units 64, a shaft 65 extending therebetween, and a pair of pillow block bearings 66 interconnecting shaft 65 and respective applicator support 59 to ensure that felt coating dischargers 54 contact moving metal strip 12 evenly and smoothly along the length of felt coating dischargers 54 to prevent damage to felt coating dischargers 54 and to apply liquid coating material evenly. Rack-and-pinion units 64, shafts 65, and pillow block bearings 66 are positioned to lie in interior region 47.

Each alignment unit 62, 63 further includes gibs 105 arranged in pairs and fixed to frame 36 on either side of the ends of applicator supports 59 for slidable engagement therewith, as shown, for example, in FIGS. 3–7. Each pair of gibs 105 provides a channel for respective applicator support 59 to slide therethrough. Gibs 105 are configured to block rotation, or yawing, of applicator supports 59, and, hence, applicators 52 fixed thereto about a vertical axis to maintain a longitudinal axis 106 of applicators 52 perpendicular to a longitudinal axis 13 of moving strip 12 when air cylinder units 58 raise and lower applicator supports 59.

Each of coaters 32, 33 includes mechanical stop units 67 to limit movement of felt coating dischargers 54 toward moving metal strip 12, as shown, for example, in FIG. 3. A pair of mechanical stop units 67 are configured to limit movement of felt coating discharger 54 of upper dispenser unit 48 toward upper surface 60 and a pair of mechanical stop units 67 are configured to limit movement of felt coating discharger 54 of lower dispenser unit 49 toward lower surface 61.

Coating apparatus 10 further includes a sensor 23 that is configured to detect the position and width of moving metal strip 12 and provide a signal 25 indicative thereof, as shown, for example, in FIG. 1. In preferred embodiments, sensor 23 is a light screen system obtained from Banner Engineering Corporation of Minneapolis, Minn. that generates a curtain of sensing beams of light to detect the position and width of moving metal strip 12.

Applicators 52 of upper and lower dispenser units 48, 49 are structurally similar to one another, except as otherwise noted. Each applicator 52 includes a base 68, first and second end plates 69, 95 coupled to base 68, and a retainer 70, as shown, for example, in FIGS. 3–7. Base 68 and end plates 69, 95 cooperate to define a well (not shown) sized to receive felt coating discharger 54. Retainer 70 is configured to retain felt coating discharger 54 within the well. Base 68 is formed to include plurality of conduits (not shown) configured to deliver liquid coating material from conduits 53 to felt coating discharger 54. Each of end plates 69, 95 of lower dispenser unit 49 is formed to include a drain aperture 73 to drain excess liquid coating material from the respective well, as shown, for example, in FIGS. 6 and 7.

Coating return system 28 includes a lower recovery receptacle 74 fixed to base 68 of lower dispenser unit 49, an upper recovery unit 75 including an upper recovery receptacle 76, a filter 35, and a director or 3-way valve 77, as shown, for example, in FIG. 2. Recovery receptacles 74, 76 cooperate to form a collector 110 configured to collect liquid coating material from coating applicators 52. Coating return system 28 further includes a first return conduit 34, a second return conduit 37, a third return conduit 101, a fourth return conduit 102, a fifth return conduit 103, and a sixth return conduit 104.

First return conduit 34 conducts liquid coating material from upper recovery receptacle 76 to third return conduit 101. Second return conduit 37 conducts liquid coating material from lower recovery receptacle 74 to third return conduit 101. Third conduit 101 conducts liquid coating material from first and second return conduits 34, 37 to filter 35 which filters liquid coating material being reclaimed for reuse. Fourth return conduit 102 conducts liquid coating material from filter 35 to valve 77.

Fifth and sixth return conduits 103, 104 couple valve 77 to liquid supply unit 16 and liquid usage detector 18, respectively, for fluid communication. Controller 26 is coupled to valve 77 to actuate valve 77 to direct recovered liquid coating material to the reservoir of liquid usage detector 18 during normal operation of coating apparatus 10 and to the container of liquid supply unit 16 when coating apparatus 10 is purged of liquid coating material.

Lower recovery receptacle 74 is fixed to a lower end 78 of base 68 of applicator 52 of lower dispenser unit 49 in interior region 47, as shown, for example, in FIGS. 3–7. Lower recovery receptacle 74 is positioned to lie between base 68 of lower dispenser unit 49 and applicator support 59 of lower applicator mover 57 when lower applicator mover 57 moves coating applicator 52 between the opened and closed positions. Lower recovery receptacle 74 extends outwardly from and around base 68 of lower dispenser unit 49 to receive liquid coating material that drains from felt coating discharger 54 through drain apertures 73 formed in end plates 69, 95. Lower recovery receptacle includes a first end 107 and a second end 108.

Liquid coating material collected in lower recovery receptacle 74 drains therefrom through a drain aperture 72 formed therein at second end 108 into second return conduit 37, as shown, for example, in FIGS. 6 and 7. In preferred embodiments, drain aperture 72 is formed in first end 107 of lower recovery receptacle 74.

Upper recovery unit 75 includes upper recovery receptacle 76, a drive linkage 79 coupled to a first end 80 of upper recovery receptacle 76, and an idler linkage 112 coupled to a second end 82 of upper recovery receptacle 76, as shown, for example, in FIGS. 3–7. Drive linkage 79 is configured to move upper recovery receptacle 76 between a lower, liquid recovery position, as shown, for example, in FIGS. 4 and 6, and an out-of-the-way, side storage position, as shown, for example, in FIGS. 5 and 7, when upper applicator mover 56 moves coating applicator 52 of upper dispenser unit 48 between the opened and closed positions. Idler linkage 112 is configured to support second end 82 of upper recovery receptacle 76 as upper recovery receptacle 76 is rotated between the recovery and storage positions, as shown, for example, in FIGS. 6 and 7.

Upper recovery receptacle 76 is positioned to lie directly under coating applicator 52 of upper dispenser unit 48 between coating applicator 52 of upper dispenser unit 48 and upper surface 60 when upper recovery receptacle 76 is in the liquid recovery position. Upper recovery receptacle 76 is positioned to lie to the side of coating applicator 52 of upper dispenser unit 48 when upper recovery receptacle 76 is in the storage position.

A drain aperture 71 is formed in second end 82 of upper recovery receptacle 76, as shown, for example, in FIG. 6. In preferred embodiments, drain aperture 71 is formed in first end 80. First return conduit 34 is coupled to drain aperture 71 to conduct liquid coating material recovered by upper recovery receptacle 76 away from upper recovery receptacle 76 for reuse.

Drive linkage 79 includes a first link 83, a V-shaped second link 84, and a first stud link 85, as shown, for example, in FIGS. 4 and 5. First link 83 includes a first end 86 coupled to upper end face 44 of frame 36 for pivotable movement of first link 83 and a second end 87. Second link 84 includes a first arm 88 and a second arm 89 fixed to first arm 88 to form the V shape of second link 84 and a vertex therebetween. First and second arms 88, 89 are fixed against movement relative to one another. Second link 84 includes a first end 91 coupled to second end 87 of first link 83 for pivotable movement of second link 84 relative to first link 83 and a second end 92 fixed to first end 80 of upper recovery receptacle 76.

First stud link 85 interconnects second link 84 to first end plate 69 of upper dispenser unit 48, as shown, for example, in FIGS. 4 and 5. First stud link 85 extends through the vertex of second link 84 and is threaded into first end plate 69 of upper dispenser unit 48. A spring pin 93 extends through an end of first stud link 85. A washer 94 is positioned to lie between spring pin 93 and second link 84. An opposite end of first stud link 85 is threaded into first end plate 69.

Idler linkage 112 includes an idler link 81, a second stud link 98, a second spring pin 99, and a second washer 100, as shown, for example, in FIGS. 6 and 7. Idler link 81 includes a first end 96 and a second end 97. First end 96 is coupled to second end plate 95 by second stud link 98, second spring pin 99, and second washer 100. Second end 97 of idler link 81 is fixed to second end 82 of upper recovery receptacle 76 so that idler link 81 couples second end 82 of upper recovery receptacle 76 to coating applicator 52 of upper dispenser unit 48 to support second end 82 of upper recovery receptacle 76.

Drive linkage 79 and idler linkage 112 cooperate to form a linkage unit or means for swinging upper recovery receptacle 76 between the recovery and storage positions.

Valve 77 includes an input 114, a first output 116, and a second output 118. Input 114 is located to receive liquid coating material discharged from collector 110. First output 116 is coupled to liquid coating material supply unit 16. Second output 118 is coupled to liquid usage detector 18.

Although the invention has been described in detail with reference to preferred embodiments, variations and modifications exist within the scope and spirit of the invention as defined and defined in the following claims.

What is claimed is:

1. A coating apparatus for coating a moving strip of material with liquid coating material, the coating apparatus comprising a liquid coating material supply unit configured to dispense liquid coating material, a coater including an applicator configured to apply liquid coating material provided by the liquid coating material supply unit onto a moving strip of material, and means for returning liquid coating material dispensed from the applicator to a position in the coating apparatus upstream of the coater, including means for collecting material dispensed from the applicator, wherein the means for collecting includes a recovery receptacle and the means for returning further includes means for swinging the recovery receptacle between a recovery position in which the recovery receptacle is positioned under the applicator and a storage position away from the recovery position.

2. The coating apparatus of claim 1, wherein the means for swinging includes a linkage unit coupled to the applicator and the recovery receptacle.

3. The coating apparatus of claim 2, wherein the coater further includes a frame, the linkage unit includes a drive linkage including a first link and a second link, the first link is coupled to the frame, the second link is V-shaped and includes a first end coupled to the first link, a second end coupled to the recovery receptacle, and a vertex associated with the applicator.

4. A coating apparatus for coating a moving strip of material with liquid coating material, the coating apparatus comprising a liquid coating material supply unit configured to dispense liquid coating material, a coater configured to dispense liquid coating material provided by the liquid coating material supply unit onto a moving strip of material, a liquid usage detector configured to detect a rate at which the coater dispenses liquid coating material, and means for returning liquid coating material dispensed from the coater to one of the liquid coating material supply unit and the liquid usage detector at the option of an operator of the coating apparatus, wherein the means for returning includes a collector, the coater includes an upper applicator and a lower applicator, the collector is configured to collect liquid coating material dispensed from the upper applicator and the lower applicator, the collector includes an upper recovery receptacle and a lower recovery receptacle, the upper recovery receptacle is arranged to collect liquid coating material dispensed from the upper applicator, and the lower recovery receptacle is arranged to collect liquid coating material dispensed from the lower applicator.

5. The coating apparatus of claim 4, wherein the lower recovery receptacle is mounted to the lower applicator.

6. The coating apparatus of claim 4, wherein the means for returning includes a linkage unit coupled to the coater and the upper recovery receptacle to swing the upper recovery receptacle along a path between a recovery position in which the upper recovery receptacle is positioned under the upper applicator and a storage position away from the recovery position.

7. A coating apparatus for coating a moving strip of material with liquid coating material, the coating apparatus comprising a liquid coating material supply unit configured to dispense liquid coating material, a coater configured to dispense liquid coating material provided by the liquid coating material supply unit onto a moving strip of material, a liquid usage detector configured to detect a rate at which the coater dispenses liquid coating material, and a coating return system coupled to each of the liquid coating material supply unit, the coater, and the liquid usage detector, the coating return system including a collector and a director, the collector being configured to collect liquid coating material dispensed from the coater, the director being configured to direct liquid coating material received from the collector to a selected one of the liquid coating material supply unit and the liquid usage detector, wherein the director is a valve having an input located to receive liquid coating material discharged from the collector, a first output coupled to the liquid coating material supply unit, and a second output coupled to the liquid usage detector, and the coater includes an upper applicator and a lower applicator and the collector includes an upper recovery receptacle arranged to collect liquid coating material dispensed from the upper applicator and a lower recovery receptacle arranged to collect liquid coating material dispensed from the lower applicator.

8. The coating apparatus of claim 7, wherein the coating return system further includes a filter located to filter liquid coating material passed from the collector to the director.

9. A coating apparatus for coating a moving strip of material with liquid coating material, the coating apparatus comprising a liquid coating material supply unit configured to dispense liquid coating material, a coater configured to dispense liquid coating material provided by the liquid coating material supply unit onto a moving strip of material, a liquid usage detector configured to detect a rate at which the coater dispenses liquid coating material, and a coating return system coupled to each of the liquid coating material supply unit, the coater, and the liquid usage detector, the coating return system including a collector and a director, the collector being configured to collect liquid coating material dispensed from the coater, the director being configured to direct liquid coating material received from the collector to a selected one of the liquid coating material supply unit and the liquid usage detector, wherein the coater includes an upper applicator and a lower applicator and the collector includes an upper recovery receptacle arranged to collect liquid coating material dispensed from the upper applicator and a lower recovery receptacle arranged to collect liquid coating material dispensed from the lower applicator.

10. The coating apparatus of claim 9, wherein the coating return system includes a linkage unit coupled to the coater and the upper recovery receptacle to swing the upper recovery receptacle between a recovery position in which the upper recovery receptacle is positioned under the upper applicator and a storage position away from the recovery position.

11. The coating apparatus of claim 10, wherein the linkage unit includes a drive linkage including a first link that is straight, a second link that is coupled to the first link and the upper recovery receptacle and is V-shaped so as to include a vertex, and a stud link coupled to the vertex of the second link and to the upper applicator.

12. The coating apparatus of claim 9, wherein the upper applicator includes an upper coating discharger made of felt and configured to apply liquid coating material onto an upper surface of the moving strip and the lower applicator includes a lower coating discharger made of felt and configured to apply liquid coating material onto a lower surface of the moving strip.

* * * * *